US008297557B1

(12) United States Patent
Anderson

(10) Patent No.: US 8,297,557 B1
(45) Date of Patent: Oct. 30, 2012

(54) RAILROAD CROSSING GATE HEIGHT ADJUSTMENT ASSEMBLY AND METHOD

(76) Inventor: Jonathan S. Anderson, Bradenton, FL (US)

( * ) Notice: Subject to any disclaimer, the term of this patent is extended or adjusted under 35 U.S.C. 154(b) by 0 days.

(21) Appl. No.: 13/162,897

(22) Filed: Jun. 17, 2011

(51) Int. Cl.
*B61L 23/00* (2006.01)

(52) U.S. Cl. ..... 246/111; 246/118

(58) Field of Classification Search ..... 246/111–125
See application file for complete search history.

(56) References Cited

U.S. PATENT DOCUMENTS

| | | | | |
|---|---|---|---|---|
| 2,633,169 | A * | 3/1953 | Siems | 81/457 |
| 3,394,498 | A * | 7/1968 | Reinitz et al. | 49/141 |
| 4,090,685 | A * | 5/1978 | Pappas | 246/125 |
| 6,142,426 | A * | 11/2000 | Zaro et al. | 246/125 |
| 6,523,788 | B2 * | 2/2003 | Zander | 246/111 |
| 6,776,377 | B1 * | 8/2004 | Watkins | 246/111 |
| 7,699,271 | B2 * | 4/2010 | Ward | 246/111 |
| 7,789,348 | B2 * | 9/2010 | Ruggiero et al. | 246/111 |
| 2005/0060936 | A1 * | 3/2005 | Burke | 49/49 |
| 2009/0116903 | A1 * | 5/2009 | Causey et al. | 404/6 |

* cited by examiner

*Primary Examiner* — Jason C Smith
(74) *Attorney, Agent, or Firm* — Charles J. Prescott

(57) ABSTRACT

A railroad crossing gate height adjustment assembly and method for reestablishing a height of the crossing gate of a railroad crossing gate apparatus. An elongated externally threaded pipe has a reducer threadably engageable at a lower, smaller end thereof onto, and is adjustably positionable along a length of the threaded pipe. A larger, upper end of the reducer is threadably lockable with a coupling previously secured at a lower end of a wiring conduit of the gate apparatus whereby the length of the wiring conduit is adjustably increased by an exposed length of the threaded pipe. A bushing having an external thread is lockably engageable onto a top surface of a gate base of the gate apparatus after the coupling and connected wiring conduit are removed, the bushing also having an external thread thereon for supportively receiving a lower end of the threaded pipe.

3 Claims, 7 Drawing Sheets

RAILROAD CROSSING GATE HEIGHT ADJUSTMENT ASSEMBLY AND METHOD

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to railroad gate crossing apparatus, and more particularly to a railroad crossing gate height adjustment assembly and method for repositioning the height of the crossing gate above a new road approach surface to the railroad tracks.

2. Description of Related Art

Federal and/or regional code establishes the range of height of a road or highway crossing gate of a railroad crossing and signaling apparatus. However, the road approaches on either side of the railroad tracks crossing the road are subject to substantial wear and abuse as vehicles pass over the railroad tracks. These road approaches thus deteriorate much faster than the adjacent road surface in general and require more frequent road approach repair and/or replacement so as to minimize impact to the cars and trucks passing thereover as the road approach wear becomes excessive.

In effecting such road approach repair, when the road is resurfaced by the state, county, or if the railroad needs to replace tips in the road crossing or change out the crossing panels, a crew is dispatched to raise the railroad tracks to a height that will be compatible with the new higher road surface. All railroads have tie change out programs each year. Most of the road crossings during this tie change out program are usually redone resulting in the road and track being raised thus affecting the height of the crossing gate, although the railroad tracks themselves remain fixed and unaltered in height. The road approach immediately adjacent to the tracks is typically coated over with an additional layer of road surface material such as asphalt or concrete. Because the crossing gate, when closed, is positioned at a short distance from the railroad tracks, the additional road repair layer added to the road approach diminishes the effective height of the crossing gate above the new road approach surface.

When such repairs occur, and the minimum required height of the crossing gate is thus effectively diminished, a separate maintenance procedure reestablishes and raises the height of the crossing gate when down in the "train approaching" position. Because there is a wiring conduit which extends between the gate base fixed into the ground and the gate mechanism positioned at the upper end of the wiring conduit, the typical maintenance procedure requires that this wiring conduit be removed, after which the gate mechanism and connected crossing gate are lifted upwardly on the signal mast of the crossing gate apparatus. The bundle of internal wiring within the wiring conduit is then disconnected at one end or cut so that the original wiring conduit may be removed and a longer one of exact new length installed with the internal wiring bundle being reinstalled and reconnected within the new longer wiring conduit. Thereafter, the gate mechanism is then lowered slightly so that the lower coupling at the end of the new wiring conduit may be reconnected to the top surface of the gate base. This procedure must be followed each time the road approach is resurfaced.

Applicant routinely engages in this activity as an employee of a national railroad company. He advises that a typical height reestablishment of the crossing gate will take a crew of three employees approximately a day if a signal crew of four men and a foreman with a backhoe and a boom truck to dig the gate foundation up and raise it with the boom truck is not available. When disconnecting the crossing gate wires, protection over the crossing must be provided with a 100J stop and flag railroad crossing for all trains which means the train must stop short of the railroad crossing. A member of the train crew stops traffic, puts two fuses in the road and instructs the train to cross the road, gets back on the train and proceeds on. Each train must do this until the gate wires are connected back up and the crossing gate is tested. With the four man signal crew, it may take ½ day or more depending on if there are no utilities (like gas, fiber, water or electric). If there are and the backhoe can't be used, it must be dug by shovel. This way is used most because the 100J stop and flag crossing only needs to be used when the boom truck lifts the crossing signal to the right height and the lights have been refocused and the crossing retested.

When the present invention is used on new crossing gate installations and installed while building and wiring the crossing gate, one man will be able to raise the gate height in about ½ hour. New gate mechanisms have more than enough slack on the wires so that the gate could be raised for many years. Slack on the wires is pushed back into the gate base. All the slack on the wires may also be clamped inside the gate mechanism so that, before the gate is raised, the clamp can be loosened and the wire will not get tangled up while the gate is being raised.

The present invention provides for an assembly which facilitates present and subsequent height readjustment of the crossing gate without the necessity of replacing the original wiring conduit and without the necessity of rewiring of the crossing gate apparatus.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to a railroad crossing gate height adjustment assembly and method for reestablishing a height of the crossing gate of a railroad crossing gate apparatus. An elongated externally threaded pipe has a reducer threadably engageable at a lower, smaller end thereof onto, and is adjustably positionable along a length of the threaded pipe. A larger, upper end of the reducer is threadably lockable with a coupling previously secured at a lower end of a wiring conduit of the gate apparatus whereby the length of the wiring conduit is adjustably increased by an exposed length of the threaded pipe. A bushing having an external thread is lockably engageable onto a top surface of a gate base of the gate apparatus after the coupling and connected wiring conduit are removed, the bushing also having an external thread thereon for supportively receiving a lower end of the threaded pipe.

It is therefore an object of this invention to substantially reduce the cost of reestablishing the height of the crossing gate of a railroad crossing signal apparatus after the road approach adjacent the railroad tracks is raised by repair resulting from vehicle traffic over the railroad tracks.

It is another object of this invention to permanently reduce subsequent cost of height reestablishment of the crossing gate of a railroad crossing gate apparatus for virtually all subsequent road approach repair.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Exemplary embodiments are illustrated in reference figures of the drawings. It is intended that the embodiments and figures disclosed herein are to be considered to be illustrative rather than limiting.

DETAILED DESCRIPTION OF THE INVENTION

Nomenclature

Figure 1:
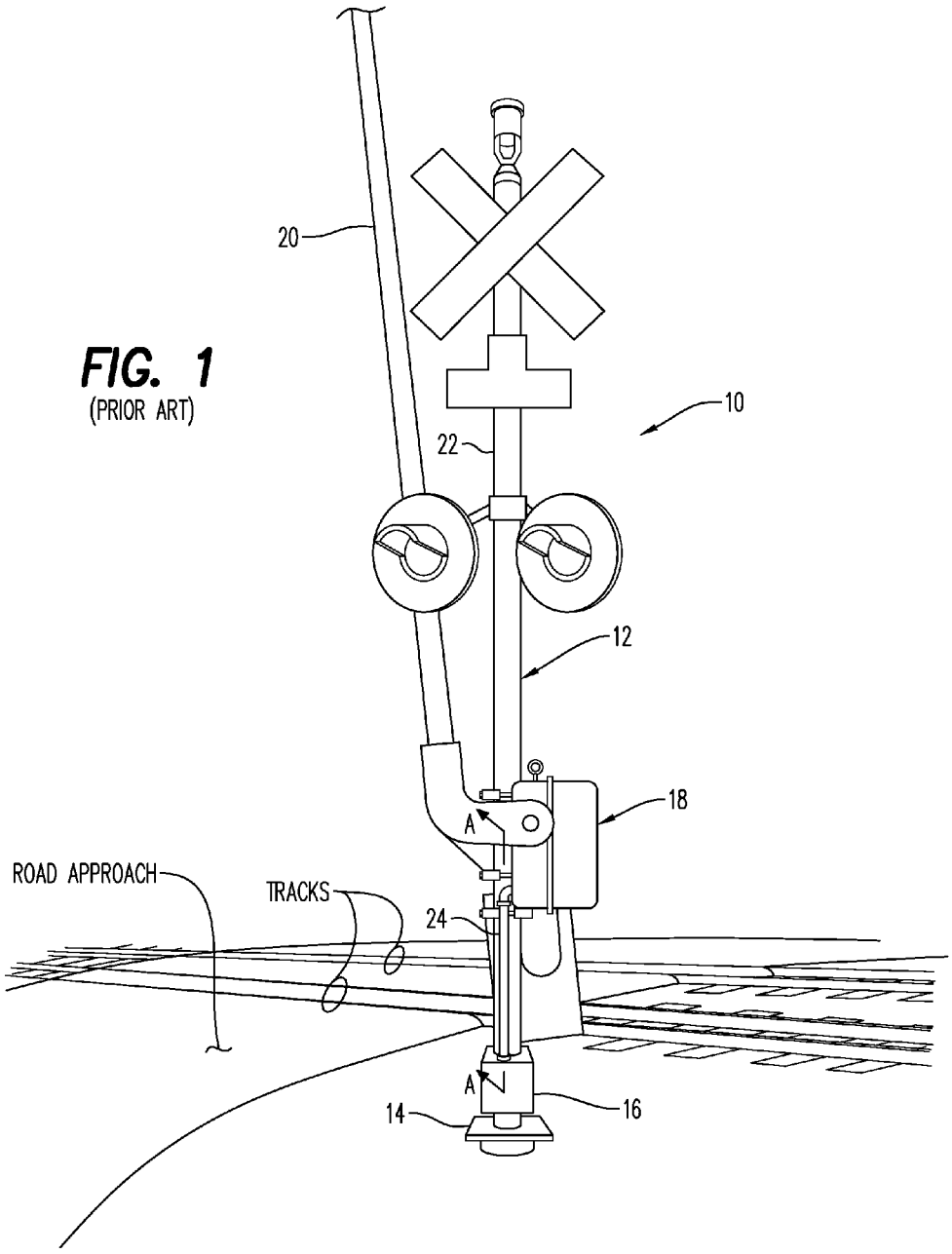
FIG. 1 (PRIOR ART)
FIG. 1 is a perspective view of a railroad crossing gate apparatus 10 positioned adjacent to the tracks of a railroad tracks crossing a roadway. (Prior Art)
Figure 2:
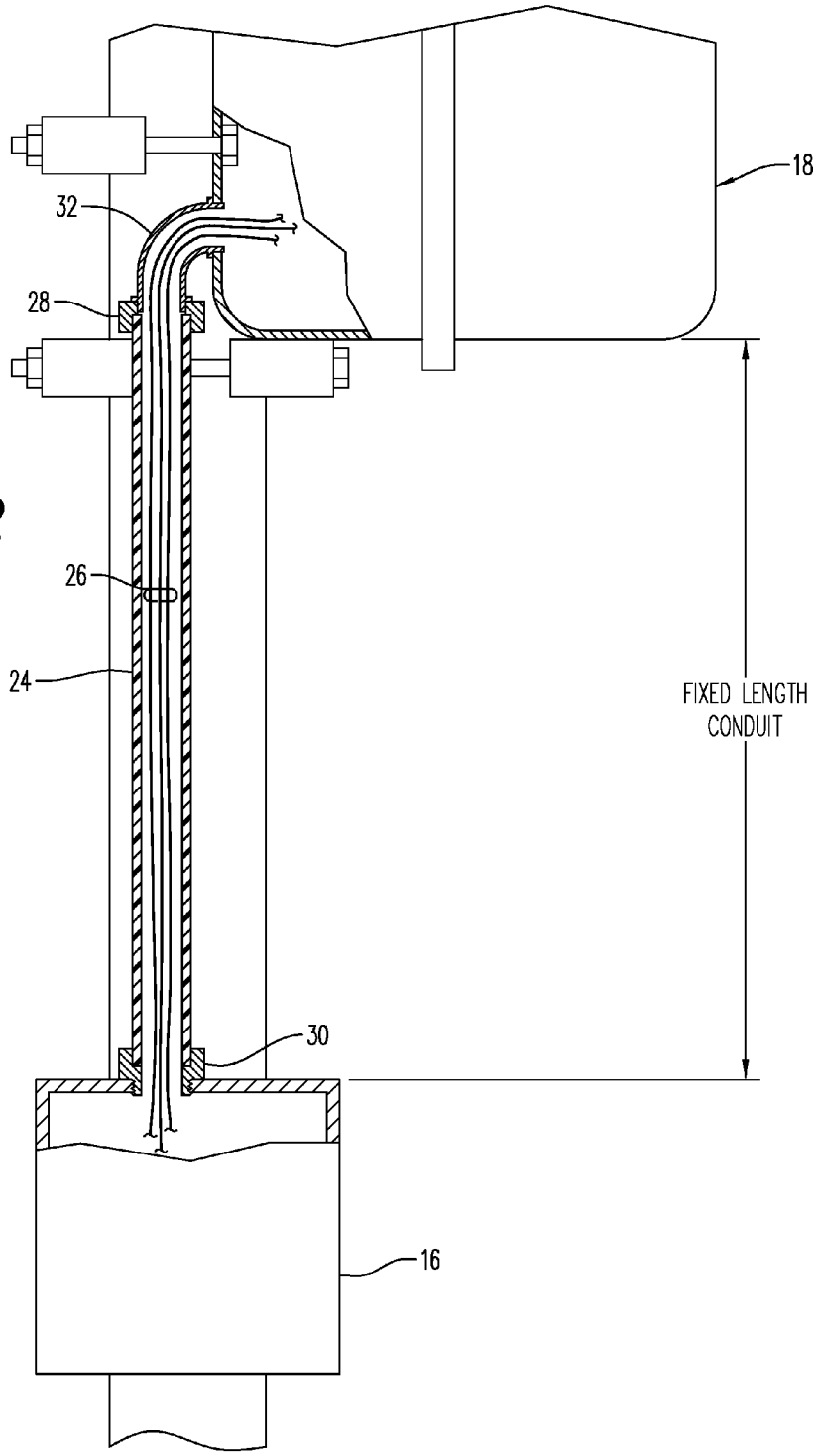
FIG. 2 (PRIOR ART)
FIG. 2 is an enlarged broken view of the lower portion of FIG. 1.

10. railroad crossing gate apparatus
12. warning signal assembly
14. signal foundation
16. gate base
18. gate mechanism
20. highway crossing gate
22. signal mast
24. flexible wiring conduit
26. internal wiring
28. upper coupling
30. lower coupling
32. conduit elbow
34. support bracket
36. gate support arm
38. gate counterweight
40. height adjustment assembly
42. threaded pipe
44. reducer
46. internal thread
48. internal thread
50. jam nut
52. bushing
54. external thread
56. internal thread
58. lifting ring Referring now to the drawings and firstly to FIGS. 1 and 2, a typical prior art railroad crossing gate apparatus is there shown generally at numeral 10 in FIG. 1 and includes a warning signal apparatus including a highway crossing gate 20 pivotally operably connected to a gate mechanism 18. In well known fashion, when a train is approaching the road on the tracks, the flashing signals warn oncoming traffic of the oncoming train while the crossing gate 20 pivots downwardly into a horizontal position above the road approach surface. All of these components are supported on a signal mast 22 which extends downwardly into a gate base 16 which in turn is supported in the ground securely by a signal foundation 14.

In FIG. 2, it is seen that the conventional arrangement for housing the wiring which extends upwardly from the gate base 16 into the gate mechanism 18 is protectively housed within an elongated wiring conduit 24. The lower end of the wiring conduit 24 is secured into a lower coupling 30 threadably engaged into an internally threaded hole in the top of the gate base 16. The upper end of the wiring conduit 24 is permanently secured or tightly secured into an upper coupling 28 which in turn is attached to a conduit elbow 32 to guide and protect the wiring bundle 26 extending therethrough.

Figure 3:
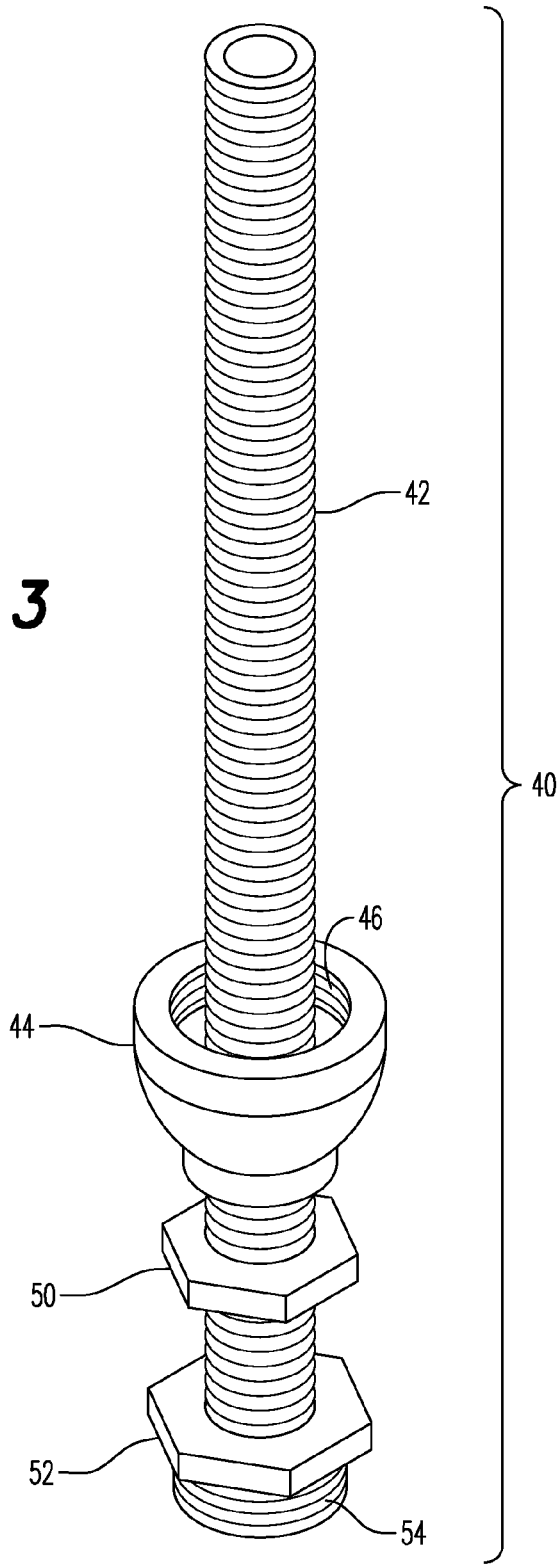
FIG. 3 is a perspective view of the invention.

Referring now to FIG. 3, the invention, a height adjustment assembly, is there shown generally at numeral 40 and includes an elongated threaded pipe 42 onto which a reducer 44 is threadably engaged as is a jam nut 50 and a bushing 52. The reducer 44 includes two internal threads 46 and 48 best seen in FIG. 5, the upper internal thread 46 being larger while the smaller internal thread 48 being smaller and sized to threadably engage over and along the length of the threaded pipe 42. The jam nut 50 is also threadably engaged onto the threaded pipe 42 below the reducer 44 while the bushing 52 includes an internal thread 56, again best seen in FIG. 5, and an external thread 54 which is sized to threadably and lockably engage into the threaded hole formed in the top surface of the gate base 16 after the lower coupling 30 has been removed.

Figure 4:
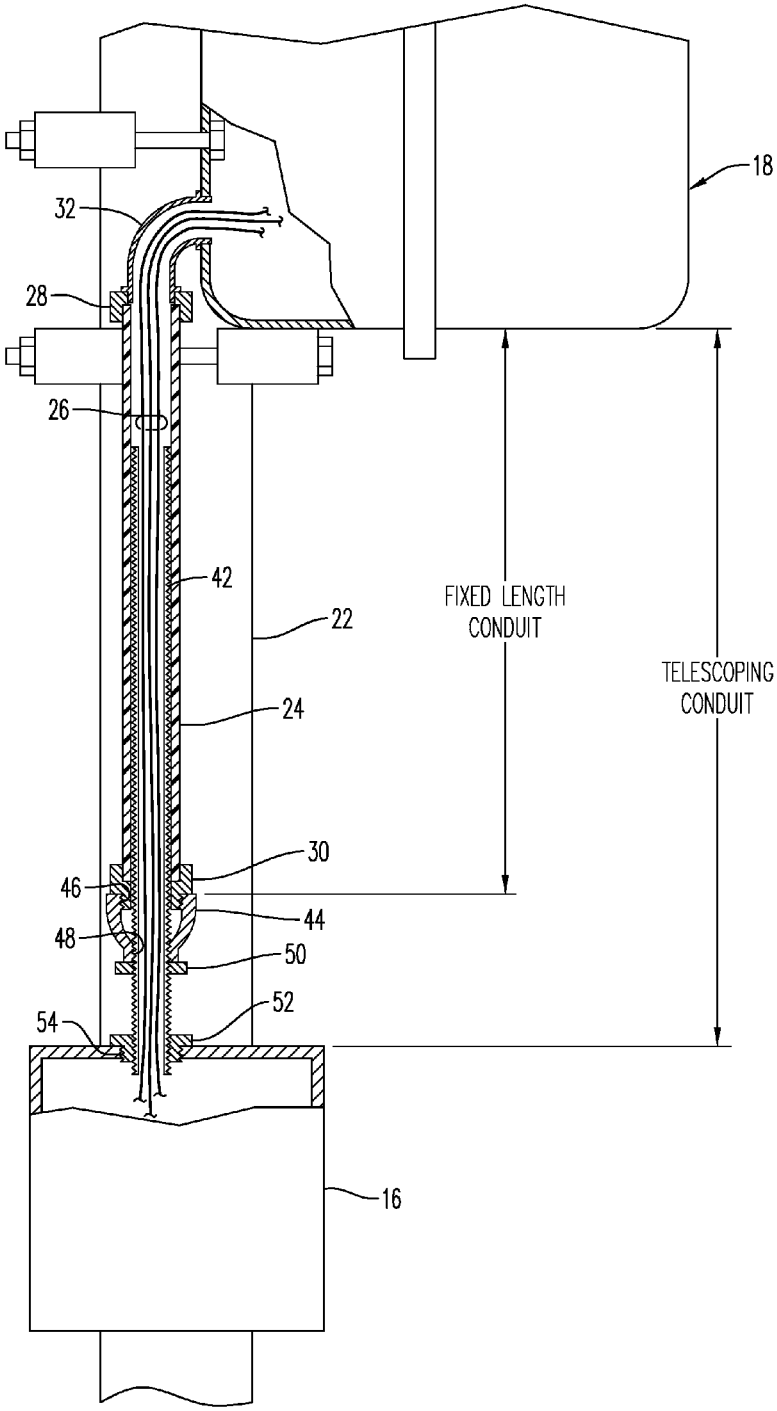
FIG. 4 is a view similar to FIG. 2 after the invention of FIG. 3 has been installed during height reestablishment of the gate mechanism 18 and crossing gate attached thereto (not shown for clarity).
Figure 5:
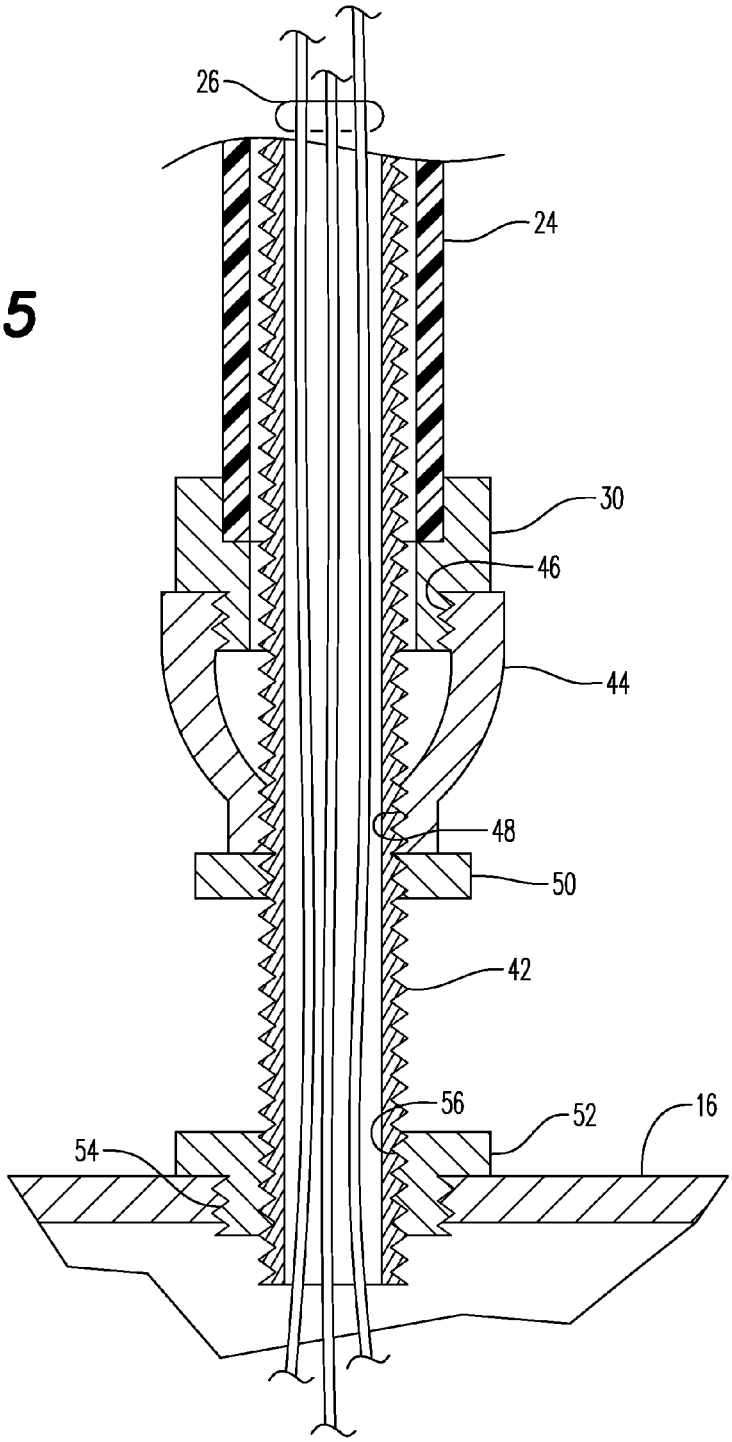
FIG. 5 is an enlarged section view of the lower portion of FIG. 4.
Figure 6:
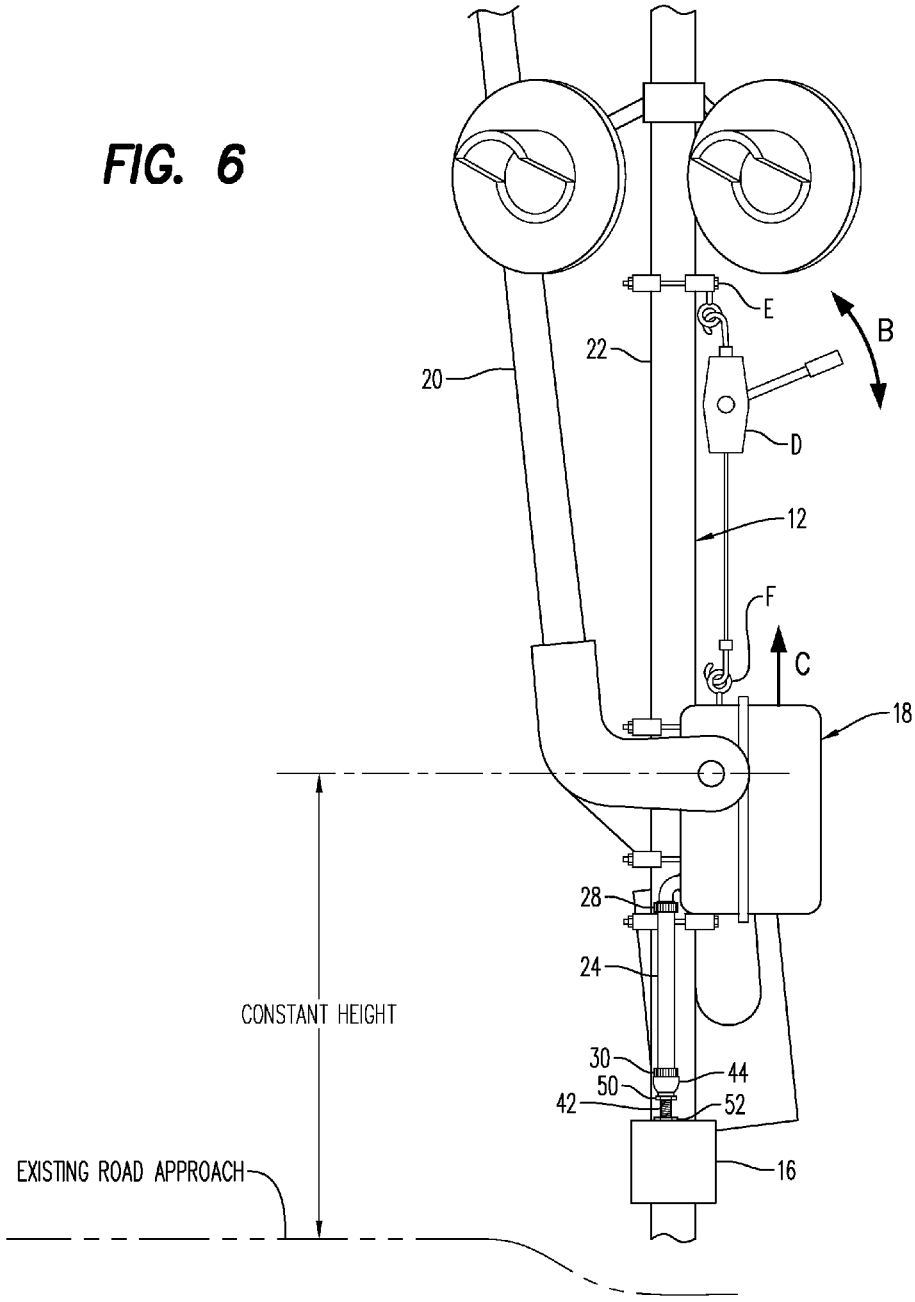
FIG. 6 is a perspective view of the railroad crossing gate apparatus showing the invention after installation therein and after the road approach has been elevated by repair.

Referring additionally to FIGS. 4 to 6, after the road approach has been repaired and increased in height by the addition of road repair material such as asphalt, concrete or the like, the height of the crossing gate which must be maintained at a constant height above the road surface must be increased by the raising of the gate mechanism 18 along the length of the upright signal mast 22. To facilitate this raising of the gate mechanism 18 and the pivotally supported crossing gate 20 so as to reestablish the required constant height of the gate crossing gate 20 when in a down position, a come-along or winch D is fastened at an upper end thereof to an eye bracket E clamped onto the signal mast 22 at a height above the gate mechanism 18. A lower end of the come-along D is attached to an eye-bolt 58 which has been secured into the upper surface of the gate mechanism 18. By operation of the come-along through movement of its lever F in the direction of arrow B, the gate mechanism 18 is lifted in the direction of arrow C.

Prior to the above upward readjustment or upward repositioning of the gate mechanism 18, the lower coupling 30 attached at the lower end of the existing wiring conduit 24 is unthreaded from the threaded aperture formed in the top surface of the gate base 16 and the wiring is disconnected from within the gate base and removed from the wiring conduit 24. As the wiring conduit 24 is somewhat flexible, it may be deflected laterally so that the invention 40, and particularly the threaded pipe 42 may then be inserted into and through the lower coupling 30, after which the upper internally threaded end of the reducer 44 is threadably engaged onto and locked with the external threads of the lower coupling 30. The lower end of the threaded pipe 42 is then threadably engaged into bushing 52 after the bushing has been threadably secured into the threaded aperture in the top of the gate base 16. Then, by simply rotating the bushing 44 in either direction on the threaded pipe 42, a proper new height for the telescoping conduit, in keeping with the previously described upward height adjustment of the gate mechanism 18 is thus established. Retightening of the previously loosened support brackets 34 secures the new positioning of the gate mechanism 18, after which the come-along D is removed.

Figure 7:
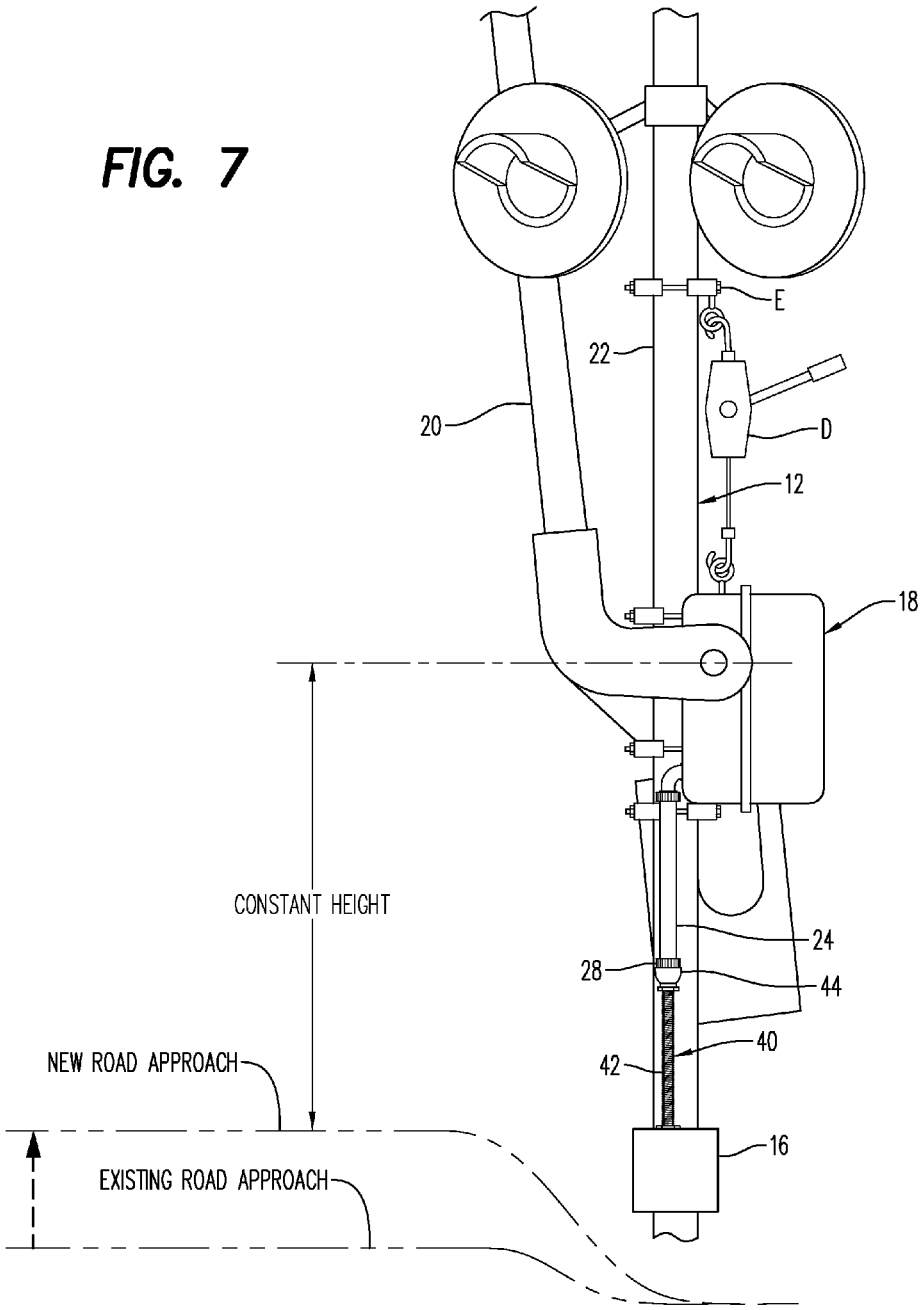
FIG. 7 is a view similar to FIG. 6 showing a subsequent height reestablishment after a further road approach elevated by repair has been implemented.

Referring now to FIG. 7, a subsequent road approach repair causing an additional height elevation of the road approach surface is there shown. The procedure for increasing the height of the crossing gate 20 and the supporting gate mechanism 18 is as previously described. However, no rewiring is required, nor must the wiring conduit 24 be disconnected in any way. The height adjustment is simply effected as the gate mechanism 18 is elevated by come-along D as previously described by the simple rotation of the reducer 44 after the jam nut 50 has been loosened. This exposes an additional length of the threaded pipe 42 as required to maintain the constant height of the crossing gate above the new road approach surface.

While a number of exemplary aspects and embodiments have been discussed above, those of skill in the art will recognize certain modifications, permutations and additions and subcombinations thereof. It is therefore intended that the following appended claims and claims hereinafter introduced are interpreted to include all such modifications, permutations, additions and subcombinations that are within their true spirit and scope.

The invention claimed is:

1. A railroad crossing gate height adjustment assembly for reestablishing a height of the crossing gate of a railroad crossing gate apparatus comprising:

an elongated externally threaded pipe;

a reducer threadably engageable at a lower, smaller end thereof onto, and adjustably positionable along a length of, said threaded pipe, a larger, upper end of said reducer threadably engageable lockable with a coupling secured at a lower end of a wiring conduit of the gate apparatus whereby the length of the wiring conduit is adjustably increased by said threaded pipe;

a bushing having an external thread lockably engageable into a top surface of a gate base of the railroad crossing gate apparatus after removal of the coupling and having an external thread thereon for supportively receiving a lower end of said threaded pipe.

2. A railroad crossing gate height adjustment assembly for reestablishing a height of a crossing gate of a railroad crossing gate apparatus, the gate apparatus including an upright signal mast secured in the ground, a gate base connected to a lower portion of the signal mast, a gate mechanism connected to the signal mast above the gate base, the gate mechanism operably supporting the crossing gate, and an elongated wiring conduit of fixed length connected at each end thereof, and extending between, the gate base and the gate mechanism, said assembly comprising:

an elongated externally threaded pipe;

a reducer threadably engageable at a lower, smaller end thereof onto, and adjustably positionable along a length of, said threaded pipe, a larger, upper end of said reducer threadably engageable with a coupling secured at a lower end of the wiring conduit whereby the length of the wiring conduit is adjustably increased by said threaded pipe;

a bushing having an external thread lockably engageable onto a top surface of a gate base of the railroad crossing gate apparatus after removal of the coupling and having an external thread thereon for supportively receiving a lower end of said threaded pipe.

3. A method of reestablishing a height of a crossing gate of a railroad crossing gate apparatus, the gate apparatus including an upright signal mast secured in the ground, a gate base connected to a lower portion of the signal mast, a gate mechanism connected to the signal mast above the gate base, the gate mechanism operably supporting the crossing gate, and an elongated wiring conduit of fixed length connected at each end thereof by an upper and a lower coupling and extending between the gate base and the gate mechanism, said method comprising:

a. disconnecting the lower coupling and wiring conduit connected thereto from the gate base;

b. reestablishing a new height of the gate mechanism and wiring conduit to raise the height of the crossing gate to a specified distance above a new road approach to a train track;

c. inserting one end of an elongated externally threaded pipe into and through the lower coupling;

d. threadably engaging a lower, small end of a reducer having a first internal thread at a lower, small end thereof onto, and adjustably positioned along a length of, said threaded pipe;

e. threadably engaging larger, upper end of a second internal thread of said reducer with the second coupling secured at a lower end of the wiring conduit whereby the length of the wiring conduit is adjustably increased by an exposed length of said threaded pipe;

f. threadably engaging an external thread of a bushing into a top surface of a gate base of the railroad crossing gate apparatus after removal of the second coupling;

g. threadably engaging a second end of the threaded pipe into an internal thread of said bushing for supporting said threaded pipe; and h. tightening a jam not threadably engaged over the exposed portion of the threaded pipe against a lower end of said reducer to secure a new selected length of the wiring conduit.

* * * * *